US008711039B2

(12) United States Patent
Horisawa et al.

(10) Patent No.: US 8,711,039 B2
(45) Date of Patent: Apr. 29, 2014

(54) ANTENNA MODULE AND WIRELESS COMMUNICATION APPARATUS

(75) Inventors: Shozo Horisawa, Chiba (JP); Kanahiro Shirota, Kanagawa (JP); Tsuguharu Miura, Chiba (JP)

(73) Assignee: Sony Corporation (JP)

( * ) Notice: Subject to any disclaimer, the term of this patent is extended or adjusted under 35 U.S.C. 154(b) by 281 days.

(21) Appl. No.: 13/343,958

(22) Filed: Jan. 5, 2012

(65) Prior Publication Data

US 2012/0176275 A1 Jul. 12, 2012

(30) Foreign Application Priority Data

Jan. 12, 2011 (JP) ..... P2011-004270

(51) Int. Cl.
*H01Q 1/24* (2006.01)

(52) U.S. Cl.
USPC ..... 343/700 MS; 343/846

(58) Field of Classification Search
USPC ..... 343/700 MS, 829, 846
See application file for complete search history.

(56) References Cited

U.S. PATENT DOCUMENTS 5,668,560 A * 9/1997 Evans et al. ..... 343/702
6,614,400 B2 * 9/2003 Egorov ..... 343/702
6,774,849 B2 8/2004 Umehara et al.
6,982,673 B2 * 1/2006 Yuanzhu ..... 343/700 MS
7,202,826 B2 * 4/2007 Grant et al. ..... 343/713
7,439,916 B2 * 10/2008 Wang et al. ..... 343/700 MS
7,969,361 B2 * 6/2011 Castaneda et al. ..... 343/700 MS
2002/0000938 A1 * 1/2002 Hoashi et al. ..... 343/700 MS

FOREIGN PATENT DOCUMENTS

JP 2001-332929 A 11/2001
JP 2001-339239 A 12/2001
JP 2003-092510 A 3/2003
JP 2004-312166 A 11/2004

* cited by examiner

*Primary Examiner* — Tho G Phan
(74) *Attorney, Agent, or Firm* — Lerner, David, Littenberg, Krumholz & Mentlik, LLP

(57) ABSTRACT

An antenna module includes a base member made of a resin and a copper-foil material, a first ground layer formed on a first surface of the base member, a second ground layer formed on a second surface of the base member, and an inverted-F metal-plate antenna provided on the first surface, formed by punch-cutting and folding a metal plate and including a rectangular conductive plate, a grounding conductor portion connected to the first ground layer, and a feeding conductor portion connected to a feeding point. The rectangular conductive plate is folded at a folding portion extending in a length direction and is divided in a width direction at the folding portion into a first rectangular conductive plate and a second rectangular conductive plate. The first rectangular conductive plate is parallel to the base member whereas the second rectangular conductive plate is inclined to the base member.

7 Claims, 1 Drawing Sheet

ANTENNA MODULE AND WIRELESS COMMUNICATION APPARATUS

CROSS-REFERENCE TO RELATED APPLICATION

The present application claims priority from Japanese Patent Application No. JP 2011-004270 filed in the Japanese Patent Office on Jan. 12, 2011, the entire content of which is incorporated herein by reference.

BACKGROUND

The present disclosure relates to an antenna module and a wireless communication apparatus which are usable to transmit and receive radio signals in wireless networks, local area networks, mobile communications, GPS receivers, and the like in conformity with the specifications of IEEE802.15.4, IEEE802.11 and the like.

Wireless communications technologies are employed in various fields, such as wireless networks, local area networks, mobile communications, and GPS receivers in conformity with the specifications of IEEE802.15.4, IEEE802.11 and the like. In recent years, wireless communication devices have been gradually replacing infrared communication devices in the field of remote control of various consumer electronics products.

An antenna module is necessary for a wireless communication device to radiate radio waves of predetermined frequencies into space. A half-wave dipole antenna and a $\lambda/4$ monopole antenna are used as basic antennas. The half-wave dipole antenna has a length equal to a half of the wavelength $\lambda$ in use, and a cycle of a standing wave exists thereon. The $\lambda/4$ monopole antenna has characteristics equivalent to those of dipole antennas when image currents on an infinite conducting plate are taken into account.

An inverted-F antenna, which is also used, is a monopole antenna with an end portion folded to have a low profile and with a short-circuiting portion formed near the feeding point to provide impedance matching. To further reduce the height of the antenna and to provide impedance matching, the folded horizontal portion facing the ground plane is made to be planar.

An antenna usually has a principal polarization plane, and has low gains for polarized waves that are orthogonal to the principal polarization plane. For example, a dipole antenna installed vertically has a high gain of vertically-polarized wave while a low gain of the horizontally-polarized wave. In addition, a monopole antenna has radiation pattern only above the infinite ground plane, and have no directional pattern below the ground. The inverted-F antenna has a directional pattern similar to that of the monopole antenna. The inverted-F antenna has a low gain on the opposite side of a board where the antenna is provided on the other side of the board, and has a low gain of the horizontally-polarized wave parallel to the board.

Ordinarily, in a wireless communication apparatus, an antenna is positioned to have a gain in a direction suitable for use situation. Regarding the usages of such apparatuses, however, in some cases, it is difficult to place the apparatus in a suitable direction in which radio signals are transmitted or received. In the case of a wireless-communication-type remote control system, for example, users are expected to hold a remote controller in various ways and transmit remote control signals in various directions to an antenna installed in an apparatus such as a TV set to be controlled by the remote controller. In flat-screen televisions, which have recently become popular in the market, the antenna is generally installed in a frame portion in the front surface of the television set. In some cases, the frame portion has some places allowing only vertically-polarized waves to pass therethrough and other some places allowing only horizontally-polarized waves to pass therethrough. It is preferable that the antennas be capable of transmitting or receiving both the vertically-polarized waves and horizontally-polarized waves.

In this regard, an inverted-F metal-plate antenna has been proposed which includes short-circuiting conductor plates provided to extend from several portions of periphery of the radiating conductor plate. The short-circuiting conductor plates exert plural resonant modes with different resonant lengths when electric power is applied (see, for example, Japanese Unexamined Patent Application Publication No. 2004-312166). The antenna of this type with the plural resonant modes can cover a wider band, but the effect thereof on the transmitting and receiving of the polarized waves is not disclosed.

For another example, a planar inverted-F antenna has been proposed which includes a printed board with a ground pattern which is entirely formed thereon except a region below the rectangular conductive plate of the planer inverted-F antenna (see, for example, Japanese Unexamined Patent Application Publication No. 2003-92510). Consequently, the antenna has a nearly omnidirectional antenna pattern that provides a high gain in the horizontal direction, i.e., the direction parallel to the printed circuit board, and provides a gain, which is not reduced to small, on the back side of the printed board.

For another example, an antenna unit has been proposed which includes patch antenna elements 11 and 12 provided on opposite surfaces of a board, a GND layer 13 provided between the elements, and an RF circuit 16 built inside of a hollow portion of the board (see Japanese Unexamined Patent Application Publication No. 2001-339239, paragraphs [0010] to [0020], and FIG. 1). In the antenna unit, the antenna element 11 and 12 are arranged in a peripheral of the board and the RF circuit 16 is arranged inside the board to reduce mutual influence between the antenna elements and the RF circuit 16 as much as possible.

The antenna unit is manufactured with an intention that the unit has an omnidirectional circularly polarized pattern and has an RF circuit inside a hollow portion of the body. The antenna unit has a structure in which both the module with the antenna and the RF circuit provided at the central portion inside the body are completely shielded. Hence, the antenna unit is very thick and difficult to manufacture.

A circularly polarized patch antenna apparatus has been proposed that includes circularly polarized patch antenna elements 2a, 2b, and 2c provided on outer surfaces of a cubic structure and a GND conductor body 7 and an RF circuit 92 provided on inner surfaces of the cubic structure (see Japanese Unexamined Patent Application Publication No. 2001-332929, paragraphs [0047] to [0055], and FIG. 8).

The circularly polarized patch antenna apparatus is manufactured with an intention that the apparatus has an omnidirectional circularly polarized pattern and has an RF circuit inside the cubic structure. The RF circuit 92 of the circularly polarized patch antenna apparatus is completely shielded with the GND conductor body 7. As a result, the RF circuit 92 is shielded to a very high degree, however, the downsizing and manufacturing of the antenna unit is difficult.

SUMMARY

It is desirable to provide an excellent antenna module and wireless communication apparatus favorably used in wireless networks, local area networks, mobile communications, GPS receivers, and the like in conformity with the specifications of IEEE802.15.4, IEEE802.11 and the like.

In addition, it is also desirable to provide an excellent antenna module and wireless communication apparatus whose heights are reduced with use of an inverted-F antenna, and are capable of transmitting and receiving both vertically-polarized waves and horizontally-polarized waves.

The present disclosure has been made in consideration of the foregoing circumstances. A first embodiment of the present disclosure is an antenna module including: a base member made of a resin and a copper-foil material; a first ground layer formed on a first surface of the base member; a second ground layer formed on a second surface of the base member; and an inverted-F metal-plate antenna provided on the first surface of the base member, formed by punch-cutting and folding a metal plate, and including a rectangular conductive plate, a grounding conductor portion connected to the first ground layer, and a feeding conductor portion connected to a feeding point. The rectangular conductive plate of the inverted-F metal-plate antenna is folded at a folding portion extending in a length direction and is divided in a width direction at the folding portion into a first rectangular conductive plate and a second rectangular conductive plate. The first rectangular conductive plate is parallel to the base member whereas the second rectangular conductive plate is inclined to the base member.

A second embodiment of the present disclosure is made based on the first embodiment and is configured as follows. The first rectangular conductive plate has a pattern for vertically-polarized-wave excitation. The second rectangular conductive plate has a pattern for horizontally-polarized-wave excitation and a pattern for vertically-polarized-wave excitation.

A third embodiment of the present disclosure is made on based on the first embodiment and is configured as follows. The grounding conductor portion and the feeding conductor portion project substantially linearly in the width direction from the end portion of the second rectangular conductive plate, and are inclined to the base member.

A fourth embodiment of the present disclosure is made based on the first embodiment and is configured as follows. The antenna module further includes: a signal processing circuit provided below the inverted-F metal-plate antenna and configured to process a radio signal transmitted or received by the inverted-F metal-plate antenna; and a shielding conductor member shielding the signal processing circuit.

A fifth embodiment of the present disclosure is made based on the first embodiment and is configured as follows. The rectangular conductive plate has a length $I_1$ and a width $I_2$ such that the sum of the length $I_1$ and a width $I_2$ is approximately equal to a quarter of a wavelength $\lambda$ of operation (i.e., $I_1+I_2=\lambda/4$). The length $I_1$ and the width $I_2$ are set to obtain a desired Q-value.

A sixth embodiment of the present disclosure is made based on the first embodiment and is configured as follows. A length L of each of the grounding conductor portion and the feeding conductor portion, and a width W of an interval between the grounding conductor portion and the feeding conductor portion are adjusted to obtain a desired input impedance.

A seventh embodiment of the present disclosure is a wireless communication apparatus including: a base member made of a resin and a copper-foil material; a first ground layer formed on a first surface of the base member; a second ground layer formed on a second surface of the base member; an inverted-F metal-plate antenna provided on the first surface of the base member, formed by punch-cutting and folding a metal plate, and including a rectangular conductive plate, a grounding conductor portion connected to the first ground layer, and a feeding conductor portion connected to a feeding point; a signal processing circuit configured to process a radio signal transmitted or received by the inverted-F metal-plate antenna; and a shielding conductor member shielding the signal processing circuit. The rectangular conductive plate of the inverted-F metal-plate antenna is folded at a folding portion extending in a length direction and is divided in a width direction at the folding portion into a first rectangular conductive plate and a second rectangular conductive plate. The first rectangular conductive plate is parallel to the base member whereas the second rectangular conductive plate is inclined to the base member.

The present disclosure may provide an excellent antenna module and wireless communication apparatus whose heights are reduced with use of an inverted-F antenna, and are capable of transmitting and receiving both vertically-polarized waves and horizontally-polarized waves.

The antenna module of the present disclosure includes an inverted-F metal-plate antenna that excites both the horizontally-polarized waves and the vertically-polarized waves. Hence, even if the ground layer formed on the base member is as small as approximately a quarter of the wavelength of operation, a desired radiation gain and a desired directional gain can be obtained.

The antenna module of the present disclosure includes an inverted-F metal-plate antenna that excites both the horizontally-polarized waves and the vertically-polarized waves. With use of a combination of an inverted-F antenna with a patch antenna, the antenna module of the present disclosure can reduce the Q-value and cover a wider bandwidth.

The antenna module of the present disclosure includes an inverted-F metal-plate antenna that excites both the horizontally-polarized waves and the vertically-polarized waves. Hence, if installed in a chassis, the antenna module of the present disclosure can have less influence on the conductor and the dielectric body of the chassis.

The antenna module of the present disclosure includes a base member made of an FR4 resin, or made of another kind of resin and a copper-foil material in a two-layer structure; a composite antenna of both an inverted-F metal-plate antenna and a patch antenna, the composite antenna attached to a first surface of the base member; and a shielding conductor member shielding the first surface of the base member. The antenna module of the present disclosure can be manufactured at low cost. The composite antenna is formed by sheet metal working, and can be manufactured easily. In addition, a signal processing circuit to perform both an RF processing to process RF signals transmitted or received by the composite antenna and a baseband processing can be provided inside of the shielding conductor member, and thereby both the composite antenna and the signal processing circuit can be provided on the first surface of the base member. In addition, at least part of the passive elements used by the signal processing circuit can be mounted on the first surface of the base member.

The antenna module of the present disclosure has a small size that is approximately equal to a quarter of the wavelength of operation. In addition, the height of the antenna module of the present disclosure is so reduced that the antenna module including a shield case has a height of 10 mm or even smaller. Hence, the antenna unit of the present disclosure as a whole is small-sized.

Various other objectives, features and advantageous effects of the present disclosure are made clear by the description given in detail in the following embodiment of the present disclosure by referring to the drawings.

DETAILED DESCRIPTION OF EMBODIMENTS

Figure 1:
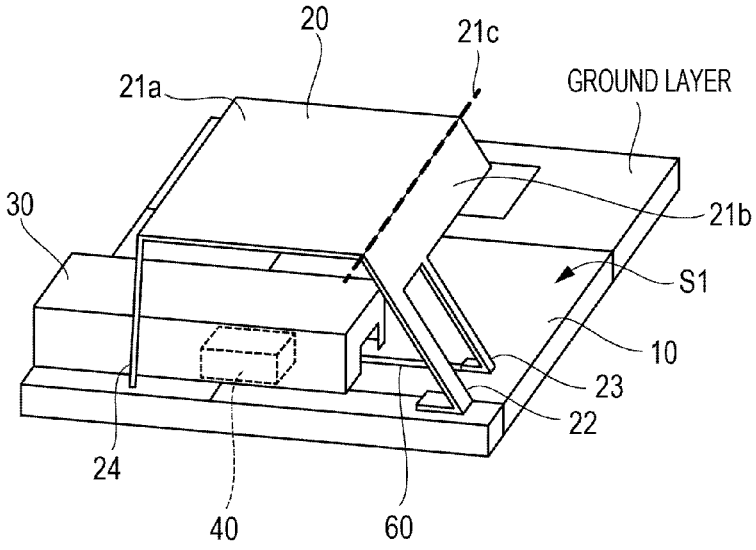
FIG. 1 is a schematic diagram illustrating the configuration of an antenna module according to an embodiment of the present disclosure.

An embodiment of the present disclosure is described in detail below by referring to the drawings.

Figure 2:
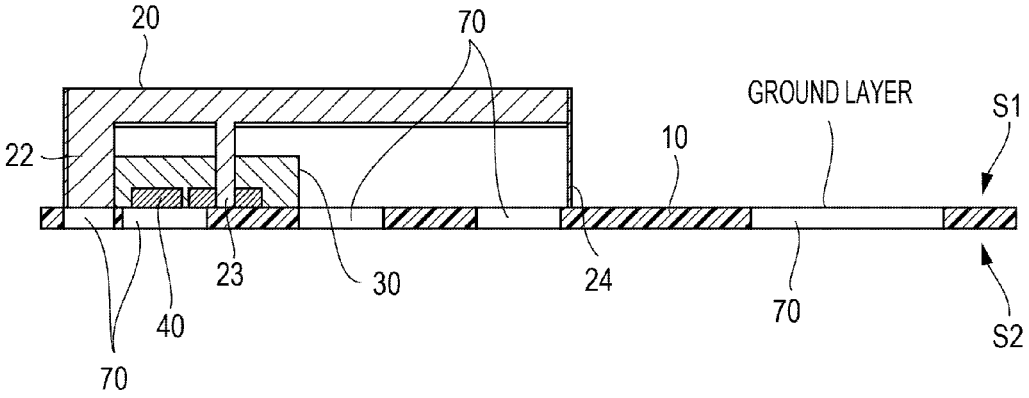
FIG. 2 is a sectional diagram illustrating the antenna module shown in FIG. 1.

FIG. 1 illustrates a schematic diagram illustrating the configuration of an antenna module according to an embodiment of the present disclosure. FIG. 2 illustrates a sectional diagram of the antenna module. The antenna module in the drawings includes a base member 10, an inverted-F metal-plate antenna 20, a shielding conductor member 30, and an RF-and-baseband processing circuit 40.

The base member 10 is a cuboid made of a resin such as FR4 (Flame Retardant Type 4), or a combination of another kind of resin and a copper-foil material, and has either a single-layer structure or a multi-layer structure. Ground patterns are formed respectively on upper and lower surfaces S1 and S2 of the base member 10. The ground patterns on the surfaces S1 and S2 are connected to each other through plural through-holes 70 penetrating the base member 10.

The inverted-F metal-plate antenna 20 is provided on the surface S1 on the base member 10 with the ground pattern. An inverted-F antenna generally refers to a monopole antenna whose height is reduced by folding a leading-end portion of the antenna and which is provided with a short-circuiting portion near the position of the feeding point to provide the impedance matching. To further reduce the height of the inverted-F antenna and to provide impedance matching, the folded horizontal portion facing the ground plane is made to be planar.

The inverted-F metal-plate antenna 20 of this embodiment is formed by punch-cutting and folding a metal plate. A grounding conductor portion 22 connected to the ground pattern and a feeding conductor portion 23 connected to a feeding point both project from a rectangular conductive plate 21. The above-mentioned feeding point refers to the point where the feeding conductor portion 23 is in contact with a feeding strip line 60 connected to the RF-band-baseband processing circuit 40.

The RF-band-baseband processing circuit 40 is mounted on the first surface S1 of the base member 10. The RF-band-baseband processing circuit 40 processes either of the RF signal transmitted from or the RF signal received by the inverted-F metal-plate antenna 20. In the illustrated example, the RF-band-baseband processing circuit 40 is shielded with the shielding conductor member 30, and is provided below the rectangular conductive plate 21 of the inverted-F metal-plate antenna 20. The shielding conductor member 30 is grounded by being plated or by using through-holes 70 formed densely but not too densely to affect the frequency of operation. In the illustrated example, the shielding conductor member 30 is grounded. In the case of a non-grounded circuit, an end portion of the circuit is drawn from but is not connected to the shielding conductor member 30. Though not illustrated, other circuit elements, such as a balun, are mounted on the first surface S1 of the base member 10. The shielding conductor member 30 shields these circuits to reduce the electromagnetic-field influence on the inverted-F metal-plate antenna 20.

A support portion 24 is formed in a forward end portion of the rectangular conductive plate 21. The support portion 24 supports the inverted-F metal-plate antenna 20 so that a predetermined space is stably provided between the rectangular conductive plate 21 and the base member 10. The position and the shape of the support portion 24 are determined appropriately to reinforce and stabilize the structure of the inverted-F metal-plate antenna 20 while reducing as much as possible the electromagnetic influence.

The rectangular conductive plate 21 is folded at a folding portion 21*c* extending in the length direction, and is divided in the width direction into two portions, i.e., a first rectangular conductive plate 21*a* and a second rectangular conductive plate 21*b*. The first rectangular conductive plate 21*a* is parallel to the base member 10 whereas the second rectangular conductive plate 21*b* slants downward. Specifically, the second rectangular conductive plate 21*b* is inclined at an angle of approximately 45 degrees down to the base member 10. The grounding conductor portion 22 and the feeding conductor portion 23 project substantially linearly in the width direction from the end portion of the second rectangular conductive plate 21*b*. Like the second rectangular conductive plate 21*b*, both the grounding conductor portion 22 and the feeding conductor portion 23 are inclined to the base member 10.

The first rectangular conductive plate 21*a* has a pattern for vertically-polarized-wave excitation as in the cases of the inverted-F antenna of the related art. On the other hand, the second rectangular conductive plate 21*b* has both a pattern for horizontally-polarized-wave excitation and a pattern for vertically-polarized-wave excitation. Hence, the antenna module of this embodiment as a whole has patterns for both vertically-polarized-wave excitation and horizontally-polarized-wave excitation. Accordingly, the antenna module built in a set can secure performance at a certain level even if one of the polarized waves is attenuated. In addition, unlike the ordinary inverted-F antenna, the antenna module has such a broad planar portion that the antenna module can function also as a patch antenna with a small difference between the gain of the vertically-polarized waves and the gain of the horizontally-polarized waves.

The sum ($I_1+I_2$) of the length ($I_1$) of the rectangular conductive plate 21 and the width ($I_2$) is approximately equal to a quarter of the wavelength of operation $\lambda$ ($\lambda/4$). The Q-value of the antenna can be increased if $I_1>I_2$, or $I_1<I_2$. To put it differently, the width $I_2$ is determined based on a desired Q-value. Unlike the ordinary inverted-F antennas, the antenna module of this embodiment can function also as a patch antenna with the broad planer portion of the rectangular conductive plate 21, and thus has a small difference between the gain of the vertically-polarized waves and the gain of the horizontally-polarized waves. In addition, the broad planer portion of the rectangular conductive plate 21, i.e., a longer length $I_1$, reduces the Q-value to widen the band of the VSWR (voltage standing wave ratio), that is, achieves a wider bandwidth.

The length L of the grounding conductor portion 22, or of the feeding conductor portion 23, and the width W between the grounding conductor portion 22 and the feeding conductor portion 23 are adjusted so that the antenna has an input impedance of approximately 50Ω.

As described above, the width $I_2$ of the rectangular conductive plate 21 and the length L of the grounding conductor portion 22, or of the feeding conductor portion 23, are determined on the basis of the desired antenna characteristics.

In addition, as described earlier, the rectangular conductive plate 21 is folded at folding portion 21*c*, and both the grounding conductor portion 22 and the feeding conductor portion 23 are not orthogonal to the base member 10 but are angled (inclined) with respect to the base member 10. Hence, the first rectangular conductive plate 21*a* of the inverted-F metal-plate antenna 20 has the same length but a lower height from the base member 10 compared with the case where both the grounding conductor portion 22 and the feeding conductor portion 23 are orthogonal to the base member 10.

The inverted-F metal-plate antenna 20 is applied with electric power from the feeding strip line 60 and a coplanar line (not illustrated) through the feeding conductor portion 23. Both the width and the length of the feeding strip line 60 can be determined as desired on the basis of the permittivity of the base member 10 and the design principle of the antenna.

As described earlier, in the antenna module shown in FIG. 1, the rectangular conductive plate 21 of the inverted-F metal-plate antenna 20 is folded at the folding portion 21*c* extending in the length direction, and is divided in the width direction into the first rectangular conductive plate 21*a* and the second rectangular conductive plate 21*b*. The first rectangular conductive plate 21*a* that is parallel to the base member 10 has the pattern for vertically-polarized-wave excitation whereas the second rectangular conductive plate 21*b* that is inclined to the base member 10 has patterns for both horizontally-polarized-wave excitation and vertically-polarized-wave excitation. Hence, the antenna unit as a whole has patterns for both vertically-polarized-wave excitation and horizontally-polarized-wave excitation. Accordingly, the antenna module built in a set can secure performance at a certain level even if one of the polarized waves is attenuated. In addition, unlike the ordinary inverted-F antenna, the antenna module has a broad planar portion, so that the antenna module can function also as a patch antenna with a small difference between the gain of the vertically-polarized waves and the gain of the horizontally-polarized waves.

Features of the antenna module shown in FIG. 1 includes: small electromagnetic influence exerted on the inverted-F metal-plate antenna 20 by the circuits mounted on the surface S1 of the base member 10; a small difference in directional gain between the horizontally-polarized wave and the vertically-polarized wave; and small variations both in the radiation gain and in the directional gain. The antenna module shown in FIG. 1 combines the functions of an inverted-F antenna and a patch antenna together to reduce the Q-value. Hence, if the antenna module is installed in a chassis capable of achieving a wider bandwidth, the influence on the conductor and the dielectric body of the chassis can be reduced.

In addition, in the antenna module shown in FIG. 1, the second rectangular conductive plate 21*b* is inclined to the base 10. In addition, both the grounding conductor portion 22 and the feeding conductor portion 23 project substantially linearly in the width direction from the end portion of the second rectangular conductive plate 21*b*. Hence, the entire body of the antenna module shown in FIG. 1 can be thinner and downsized than in a case where the second rectangular conductive plate 21*b* is not inclined but is orthogonal with respect to the base member 10. In addition, the antenna module shown in FIG. 1 is manufactured easily.

The antenna module shown in FIG. 1 includes: the base member 10 made of the FR4 resin, or made of both a resin of other kinds and a copper-foil material to form a two-layer structure; the composite antenna 20 assembled to the first surface S1 of the base member 10, the composite antenna 20 functioning as an inverted-F metal-plate antenna and a patch antenna; and the shielding conductor member 30 that shields the first surface S1 of the base member 10. Hence, the antenna module shown in FIG. 1 can be manufactured at low cost. The composite inverted-F metal-plate antenna 20 can be fabricated from a metal plate, so that the manufacturing of the inverted-F metal-plate antenna 20 is easy. In addition, the RF-band-baseband processing circuit 40 is provided inside of the shielding conductor member 30, and both the inverted-F metal-plate antenna 20 and the RF-band-baseband processing circuit 40 can be provided on the first surface S1 of the base member 10. In addition, at least part of the passive elements used in the RF-band-baseband processing circuit 40 can be mounted on the first surface S1 of the base member 10.

The size of the antenna module shown in FIG. 1 is approximately a quarter of the wavelength of operation. Specifically, for example, the height of the antenna module for the 2.4-GHz band including a shield case is so reduced that the antenna module has a height of 10 mm or even smaller. Hence, the antenna module as a whole is small-sized.

Japanese Unexamined Patent Application Publication No. 2003-92510 discloses a planar inverted-F antenna with a higher gain in the horizontal direction that is a direction parallel to the printed circuit board. The planar inverted-F antenna has no ground pattern in the region at the position below the rectangular conductive plate to make the planar inverted-F antenna approximately omnidirectional so that the gain in the horizontal direction is increased. On the other hand, in the antenna module shown in FIG. 1, the rectangular conductive plate 21 of the inverted-F metal-plate antenna 20 is folded in two, and the second rectangular conductive plate 21*b* that is inclined to the base member 10 has patterns for both horizontally-polarized-wave excitation and vertically-polarized-wave excitation. Hence, the antenna module shown in FIG. 1 is clearly different from the one disclosed in the Japanese Unexamined Patent Application Publication No. 2003-92510. In addition, in the planar inverted-F antenna disclosed in Japanese Unexamined Patent Application Publication No. 2003-92510, both the grounding conductor portion and the feeding conductor portion are orthogonal to the printed circuit board. Hence, the planar inverted-F antenna disclosed in Japanese Unexamined Patent Application Publication No. 2003-92510 does not have a small thickness as a whole.

Incidentally, Japanese Unexamined Patent Application Publication No. 2003-92510 discloses a modification where the rectangular conductive plate is folded along a folding line that extends not in the length direction but in the width direction. However, the antenna unit disclosed in the Japanese Unexamined Patent Application Publication No. 2003-92510, the rectangular conductive plate is folded to reduce the area and the volume occupied by the rectangular conductive plate and the purpose of the folding is not to increase the gain of the horizontally-polarized waves as in the present disclosure.

It should be understood by those skilled in the art that various modifications, combinations, sub-combinations and alterations may occur depending on design requirements and other factors insofar as they are within the scope of the appended claims or the equivalents thereof.

What is claimed is:

1. An antenna module comprising:

a base member made of a resin and a copper-foil material;

a first ground layer formed on a first surface of the base member;

a second ground layer formed on a second surface of the base member; and an inverted-F metal-plate antenna provided on the first surface of the base member, formed by punch-cutting and folding a metal plate, and including a rectangular conductive plate, a grounding conductor portion connected to the first ground layer, and a feeding conductor portion connected to a feeding point, wherein the rectangular conductive plate of the inverted-F metal-plate antenna is folded at a folding portion extending in a length direction and is divided in a width direction at the folding portion into a first rectangular conductive plate and a second rectangular conductive plate, and the first rectangular conductive plate is parallel to the base member whereas the second rectangular conductive plate is inclined to the base member.

2. The antenna module according to claim 1, wherein the first rectangular conductive plate has a pattern for vertically-polarized-wave excitation, and the second rectangular conductive plate has a pattern for horizontally-polarized-wave excitation and a pattern for vertically-polarized-wave excitation.

3. The antenna module according to claim 1, wherein the grounding conductor portion and the feeding conductor portion project substantially linearly in the width direction from the end portion of the second rectangular conductive plate, and are inclined to the base member.

4. The antenna module according to claim 1 further comprising:

a signal processing circuit provided below the inverted-F metal-plate antenna and configured to process a radio signal transmitted or received by the inverted-F metal-plate antenna; and a shielding conductor member shielding the signal processing circuit.

5. The antenna module according to claim 1, wherein the rectangular conductive plate has a length $I_1$ and a width $I_2$ such that the sum of the length $I_1$ and a width $I_2$ is approximately equal to a quarter of a wavelength $\lambda$ of operation (i.e., $I_1+I_2=\lambda/4$), and the length $I_1$ and the width $I_2$ are set to obtain a desired Q-value.

6. The antenna module according to claim 1, wherein a length L of each of the grounding conductor portion and the feeding conductor portion, and a width W of an interval between the grounding conductor portion and the feeding conductor portion are adjusted to obtain a desired input impedance.

7. A wireless communication apparatus comprising:

a base member made of a resin and a copper-foil material;

a first ground layer formed on a first surface of the base member;

a second ground layer formed on a second surface of the base member;

an inverted-F metal-plate antenna provided on the first surface of the base member, formed by punch-cutting and folding a metal plate, and including a rectangular conductive plate, a grounding conductor portion connected to the first ground layer, and a feeding conductor portion connected to a feeding point;

a signal processing circuit configured to process a radio signal transmitted or received by the inverted-F metal-plate antenna; and a shielding conductor member shielding the signal processing circuit, wherein the rectangular conductive plate of the inverted-F metal-plate antenna is folded at a folding portion extending in a length direction and is divided in a width direction at the folding portion into a first rectangular conductive plate and a second rectangular conductive plate, and the first rectangular conductive plate is parallel to the base member whereas the second rectangular conductive plate is inclined to the base member.

* * * * *